United States Patent [19]

Stahlecker et al.

[11] Patent Number: 4,972,554

[45] Date of Patent: Nov. 27, 1990

[54] DRAFTING UNIT FOR A SPINNING MACHINE

[75] Inventors: Fritz Stahlecker, Josef-Neidhart-Strasse 18, 7347 Bad Überkingen; Hans Stahlecker, Haldenstrasse 20, 7344 Süssen, both of Fed. Rep. of Germany

[73] Assignees: Fritz Stahlecker; Hans Stahlecker, both of Fed. Rep. of Germany

[21] Appl. No.: 488,218

[22] Filed: Mar. 5, 1990

[30] Foreign Application Priority Data

Mar. 7, 1989 [DE] Fed. Rep. of Germany ..... 3907315
Jun. 20, 1989 [DE] Fed. Rep. of Germany ..... 3920020

[51] Int. Cl.[5] ..... D01H 5/74
[52] U.S. Cl. ..... 19/244
[58] Field of Search ..... 19/242–260

[56] References Cited

U.S. PATENT DOCUMENTS

| | | | |
|---|---|---|---|
| 2,357,243 | 8/1944 | Walker | 19/252 |
| 2,484,810 | 10/1949 | Bacon et al. | 19/244 |
| 2,589,797 | 3/1952 | Getchell | 19/260 |
| 3,212,168 | 10/1965 | Sommer | 19/258 |
| 3,228,088 | 1/1966 | Schaeffler et al. | 19/258 |
| 3,331,104 | 7/1967 | Field, Jr. | 19/244 |
| 4,734,958 | 4/1988 | Coerstges et al. | 19/258 |

FOREIGN PATENT DOCUMENTS

| | | | |
|---|---|---|---|
| 664830 | 8/1938 | Fed. Rep. of Germany | 19/244 |
| 800951 | 12/1950 | Fed. Rep. of Germany | 19/244 |
| 594633 | 6/1959 | Italy | 19/260 |
| 718926 | 11/1954 | United Kingdom | 19/252 |

*Primary Examiner*—Werner H. Schroeder
*Assistant Examiner*—John J. Calvert
*Attorney, Agent, or Firm*—Evenson, Wands, Edwards, Lenahan & McKeown

[57] ABSTRACT

In the case of a drafting unit for a spinning machine, it is provided that the pressure roller and the bottom roller of the pair of delivery rollers have a smaller diameter than the pressure roller and the bottom roller of the preceding pair of rollers, and in that the thickness of the covering of the pressure roller of the pair of delivery rollers amounts to at least approximately 4 mm. The bottom roller of the pair of delivery rollers has a profiling, the depth of which is no larger than 0.4 mm.

13 Claims, 2 Drawing Sheets

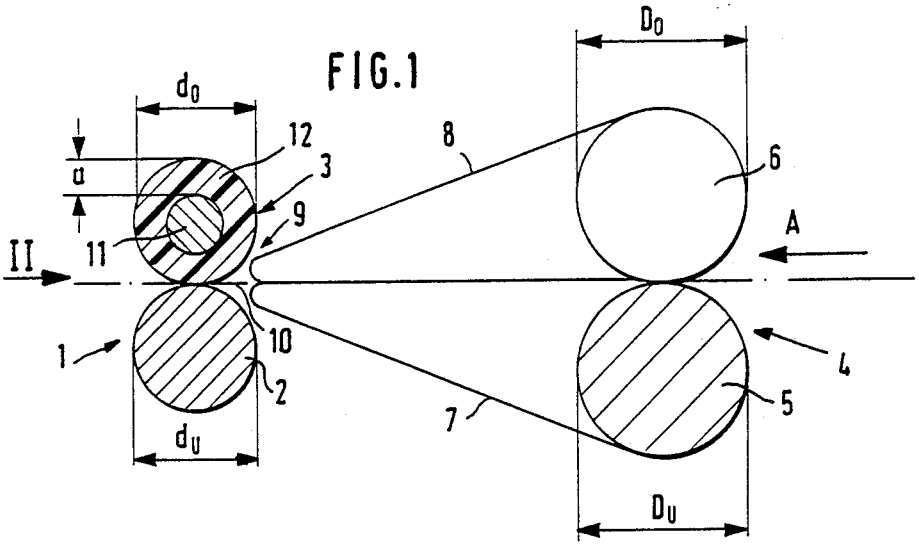
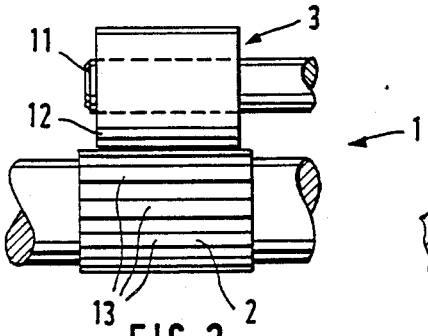
FIG.2
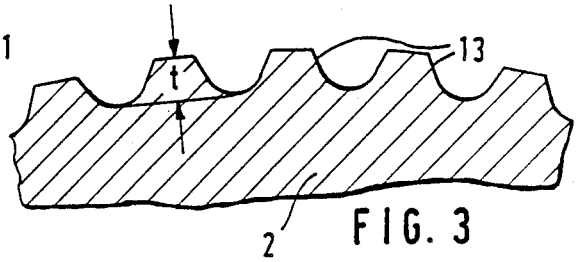
FIG. 3
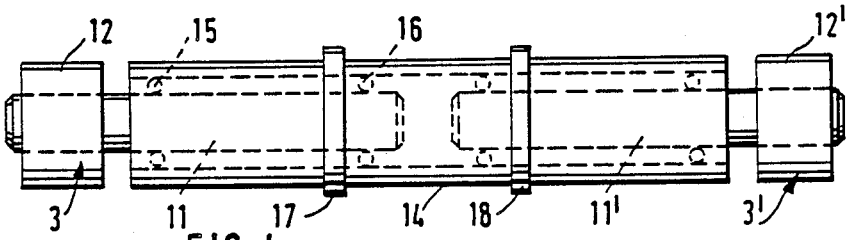
FIG.4
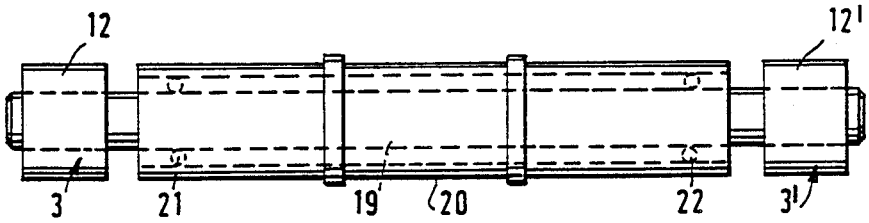
FIG.5

DRAFTING UNIT FOR A SPINNING MACHINE

BACKGROUND AND SUMMARY OF THE INVENTION

The invention relates to a drafting unit for a spinning machine having several pairs of rollers which are each formed of a pressure roller provided with a covering and a drivable bottom roller provided with a profiling, an apron guide being provided in the last drafting zone in front of a pair of delivery rollers.

It is customary in practice to construct drafting units of the initially mentioned type such that all roller pairs, from the pair of feeding rollers to the pair of delivery rollers, essentially have the same diameter. In the case of commonly assigned pending application Ser. No. 07/379,646, filed on July 14, 1989 based on German Patent Application (P 38 25 068.3), which is not a prior publication, it is provided that the diameter of the pressure roller and of the bottom roller of the pair of delivery rollers is smaller than the diameter of the rollers of the preceding pair of rollers. As a result, it is achieved that the apron guide can extend closer to the nip line of the pair of delivery rollers so that the length is reduced in which the sliver is unguided. This improves the quality of the drawn sliver.

An object of the invention is to further improve a drafting unit of the initially mentioned type with respect to the drawing quality.

This object is achieved in that the pressure roller and the bottom roller of the pair of delivery rollers have a smaller diameter than the pressure roller and the bottom roller of the preceding pair of rollers, and that the thickness of the covering of the pressure roller of the pair of delivery rollers amounts to at least approximately 4 mm.

As a result, it is achieved that the apron guide may extend relatively closely to the nip line of the pair of delivery rollers so that, particularly at very high operating speeds, the danger is reduced of disturbances of the fiber position in the sliver. In addition, it is ensured that, as a result of the minimum thickness of the covering, the effect of the covering is maintained.

In a further development of the invention, it is provided that the bottom roller of the pair of delivery rollers has a profiling, the depth of which is no larger than approximately 0.4 mm. It is also provided that the width of the ribs of the profiling at the circumferential surface of the bottom roller of the pair of delivery rollers is no larger than approximately 0.4 mm. For a further improvement, it is also provided that the width of the recesses between ribs at the circumferential surface of the bottom roller of the pair of delivery rollers is no wider than approximately 0.6 mm. Thus, the profiling of the bottom roller, particularly a ribbing, is also adapted to the reduced diameter.

In order to achieve a bearing of the pressure roller of the pair of delivery rollers which is as stable as possible despite the smaller diameter, it is provided in a first embodiment that the pressure roller of the pair of delivery rollers is constructed as an over-mounted shaft which is provided with the covering at its end. In another embodiment of the invention, it is provided for the same purpose that the pressure roller of the pair of delivery rollers has a tube-shaped basic body which, in the area of the covering, is disposed on a shaft by means of a needle bearing.

Other objects, advantages and novel features of the present invention will become apparent from the following detailed description of the invention when considered in conjunction with the accompanying drawings.

BRIEF DESCRIPTION OF THE DRAWINGS

FIG. 1 is a schematic partially sectional lateral view in the area of the pair of delivery rollers and of the last drafting zone of a drafting unit constructed according to a preferred embodiment of the invention;

FIG. 2 is a view of the drafting unit in the direction of the arrow II of FIG. 1;

FIG. 3 is a very enlarged cutout of the bottom roller of the pair of delivery rollers in the area of its surface;

FIG. 4 is a schematic view of the construction of a Pressure roller twin for two pressure rollers of the pair of delivery rollers of adjacent drafting units;

FIG. 5 is a schematic view of the construction of a pressure roller twin of the pair of delivery rollers of two adjacent drafting units having a continuous shaft;

DETAILED DESCRIPTION OF THE DRAWINGS

Figure 6:
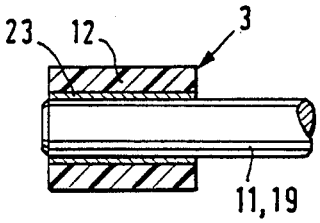
FIG. 6 is an axial sectional view of a pressure roller of a pair of delivery rollers in which the covering is arranged on a continuing shaft.

FIG. 1 shows only the last drafting zone of a drafting unit through which a sliver passes in the direction of the arrow (A) which has already passed through at least one predrafting zone or another drafting zone to which one or several pairs of rollers are assigned. The shown drafting zone is delimited by a pair of rollers 4 and a pair of delivery rollers 1. In this drafting zone, an apron guide is provided which comprises a bottom apron 7 winding around a bottom roller 5 and a top apron 8 winding around a pressure roller 6 of the Pair of rollers 4. In a known manner, the bottom apron 7 and the top apron 8, in the end 9 facing away from the pair of rollers 4, are guided around deflecting rails. In order to introduce the end area 9 of the apron guide into the wedge-shaped gap 10 formed by the pair of delivery rollers 1 as deeply as possible, the bottom roller 2 and the top roller 3 of the pair of delivery rollers 1 have a diameter ($d_U$ and $d_O$) which is reduced with respect to the diameter ($D_U$ and $D_O$) of the preceding pair of rollers 4. Pressure roller 3 of the pair of delivery rollers 1 has an outside diameter ($d_O$) of maximally 20 mm. It is provided with a covering 12 and has a shaft 11. The thickness (a) of the coating 12 should not be below approximately 4 mm; i.e., in the case of a diameter ($d_O$) of 20 mm, it should not be below 20%. The covering 12 consists of a coating which is customary for pressure rollers of drafting units, i.e., of a rubber-elastic plastic material the shore hardness of which is selected to be such that its outer circumference can be ground. In order to maintain the required thickness (a) of the covering 12 despite the small outside diameter, special constructions are provided which will be explained in detail by means of figures indicated below.

The bottom roller 2 also has an outside diameter ($d_U$) of a magnitude of 20 mm; i.e., a diameter which is clearly reduced in comparison to the outside diameters of the preceding bottom roller 5. In the embodiment shown, the bottom roller 2 is constructed as a cylinder extending through in the longitudinal direction of the machine and driven at the machine end. Instead of this embodiment, it is provided in another embodiment that the bottom roller 2 consists of one short shaft end respectively which has a common drive for each spinning point or for two spinning points respectively, in which case the individual bottom rollers 2 can be stopped separately.

The bottom roller 2 has a ribbed area 13 which, in axial direction, is slightly longer than the width of the covering 12 of the pertaining pressure roller 3. The depth (t) of the profiling should not exceed 0.4 mm (FIG. 3). The width of the ribs of the profiling 13 should also not be larger than 0.4 mm. In addition, the distance between the ribs should not be larger than 0.6 mm. This provides a profiling which may be called a "miniribbing".

FIG. 4 shows a so-called pressure roller twin by means of which the smaller diameters can be obtained for pressure rollers 3, 3' of two adjacent drafting units. The coverings 12, 12' are each arranged on shafts 11, 11' which, by means of rolling bearings 15, 16, such as roller bearings or ball bearings, are over-mounted in a common tube 14. The tube 14 is equipped with two ring collars 17, 18 which are arranged symmetrically with respect to its longitudinal center.

In this area, the tube 14 is held by means of a loading support on a common paired drafting device which is not shown and which elastically presses the two pressure rollers 3, 3' against the pertaining bottom roller 2. The shafts 11, 11' may be constructed with a diameter of approximately 8 mm. The thickness (a) of the coverings 12, 12' may then easily be 5 mm without reaching a diameter ($d_O$) of the pressure roller 3, 3' of 20 mm. In addition, it is also possible, as shown in FIG. 6, to mount the coverings 12 on thin-walled metallic bushings 23 which are then mounted on shaft 11, 11' (or corresponding to FIG. 5, on shaft 19) without exceeding a diameter ($d_O$) of 20 mm. In practice, it will be expedient to provide a diameter ($d_O$) of approximately 20 mm as the design diameter which then, in the case of required servicing operations, may be ground down to approximately 18 mm. In order to obtain a stable bearing, the two rolling bearings 15, 16 should maintain an axial distance that is as large as possible. This requires a relatively large axial distance between the pressure rollers 3, 3'. If this distance is not sufficient, a solution corresponding to FIG. 5 may be provided which permits a smaller axial distance between the pressure rollers 3, 3' (even if in the drawing this distance is shown schematically to be as large as in the embodiment according to FIG. 4).

In the embodiment according to FIG. 5, the two pressure rollers 3, 3' of a pressure roller twin are arranged on a common shaft 19 which, by means of rolling bearings 21, 22, is disposed in a tube 20. The two pressure rollers 3, 3' will then form so-called fixed rollers which cannot rotate independently of one another. Although this is unusual for pressure rollers 3, 3' of a pair of delivery rollers, it seems possible today because of the precise machining possibilities of the outside diameters and of the conical shape.

Figure 7:
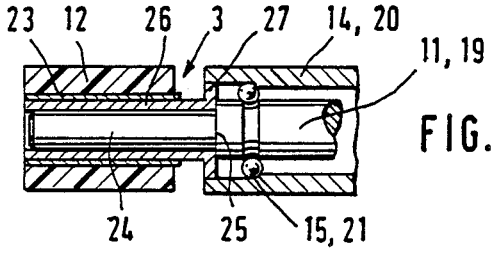
FIG. 7 is a sectional view similar to FIG. 6 of a pressure roller of a pair of delivery rollers with the use of an intermediate bushing in the area of the covering of the pressure roller.

As a deviation from the embodiments according to FIGS. 4, 5 and 6, it is provided in the embodiment according to FIG. 7 that the ends of the respectively over-mounted shafts 11 or of a common shaft 19, in the area of the pressure roller 3, have a section 24 with a reduced diameter. A reinforcing sleeve 26 is pushed onto this section 24 and supports itself at a ring collar 25 of the shafts 11 or 19. In this area, the reinforcing sleeve 26 is equipped with a ring collar 27 which is used for sealing off the tube 14 or 20. Also in this embodiment, the covering 12 is applied to a thin metallic bushing 23. However, it is also easily possible in this case, according to other preferred embodiments, to do without such a bushing and to use the reinforcing sleeve 26 as an element which can be exchanged together with the covering 12 and to which the covering 12 is applied.

Figure 8:
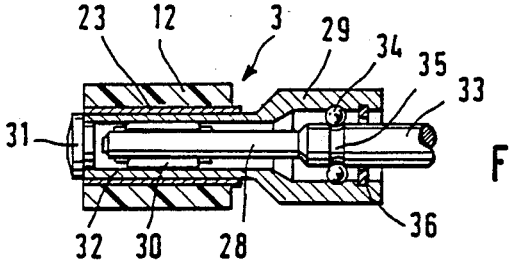
FIG. 8 is a sectional view of a pressure roller of a Pair of delivery rollers which, by means of a needle bearing and a ball bearing, is disposed on a shaft.

In the embodiment according to FIG. 8, a pressure roller 3 for a pair of delivery rollers 1 is shown in which the Pressure roller 3 is disposed on an idle shaft 33. The pressure roller 3 has a tube-shaped basic body 32 which, by means of a needle bearing 30, is disposed on a section 28 of the idle shaft 33 which has a reduced diameter. On this tube-shaped basic body 32, the covering 12 is fastened by means of a thin-walled metallic sleeve 23. The wall thickness of this metallic sleeve 23 normally amounts to less than 1 mm. The area of the needle bearing 30 is sealed off toward the outside by means of a cap 31 which is fitted into the tube-shaped basic body 32. Laterally next to the covering 12, the tube-shaped basic body 32 has a widening 29 which extends over the section of the shaft 33 with a larger diameter. In this area, the widening 29 of the basic body 32 is carried by means of a rolling bearing, particularly a ball bearing 34, the rolling bodies of which move along in a groove 35 of the shaft 33. The area of the rolling bearing is covered by means of a seal 36 fitted into the widening 29.

Figure 9:
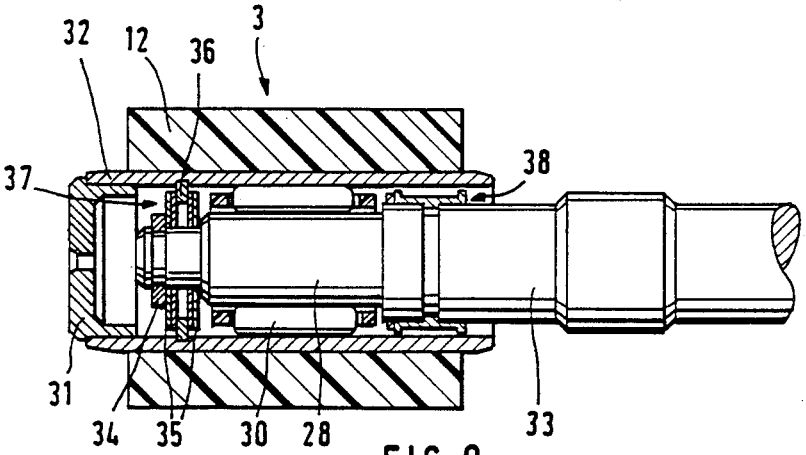
FIG. 9 is a sectional view of a pressure roller of a pair of delivery rollers which is carried by means of a needle bearing.

The pressure roller 3 of a pair of delivery rollers corresponding to FIG. 9 has a sleeve 32, the outside diameter of which amounts to 13 mm. A coating 12 is applied to this sleeve 32 which has a thickness of at least 4 mm. The sleeve 32, by means of a needle bearing 30, is disposed on a section 28 of an idle shaft 33 which is reduced in its diameter. The area of the needle bearing 30, which is filled with a lubricant, is sealed off on both sides by means of seals 37, 38.

The seal 37 located at the end of the shaft 33 is sealed off by two disks 35 which are arranged on a section of the shaft 33 having a diameter that is reduced again and which are held by means of a spring ring 34. A ring 36 is arranged between the two disks 35 which engages in a groove in the interior circumference of the sleeve 32. The open end of the sleeve 32 is secured by means of an inserted cap 31.

The seal 38 located on the opposite side is formed by a profiled body which, by means of two radial ring collars disposed at an axial distance with respect to one another, is located opposite the interior circumferential surface of the sleeve 32.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A drafting unit for a spinning machine having several pairs of rollers which are each formed of a pressure roller provided with a covering and a drivable bottom roller provided with a profiling, an apron pair being provided in a last drafting zone prior to a pair of delivery rollers, wherein the pressure roller and the bottom roller of the pair of delivery rollers has a smaller diameter ($d_O$, $d_U$) than the pressure roller and the bottom roller of a preceding pair of rollers, and wherein the of the covering of the pressure roller of the pair of delivery rollers has a thickness that amounts to at least approximately 4 mm.

2. A drafting unit according to claim 1, wherein the diameter ($d_O$) of the pressure roller of the pair of delivery rollers amounts to approximately 20 mm or less.

3. A drafting unit according to claim 1, wherein the thickness (a) of the covering of the pressure roller of the pair of delivery rollers is designed to measure approximately 20% of the diameter ($d_O$).

4. A drafting unit according to claim 1, wherein the bottom roller of the pair of delivery rollers has a profiling of ribs, the depth (t) of which is no larger than approximately 0.4 mm.

5. A drafting unit according to claim 4, wherein the width of the ribs of the profiling at a circumferential surface of the bottom roller of the pair of delivery rollers is no larger than approximately 0.4 mm.

6. A drafting unit according to claim 5, wherein the circumferential surface of the bottom roller of the pair of delivery rollers has a recess width between ribs no wider than approximately 0.6 mm.

7. A drafting unit according to claim 4, wherein the circumferential surface of the bottom roller of the pair of delivery rollers has a recess width between ribs no wider than approximately 0.6 mm.

8. A drafting unit according to claim 1, wherein the pressure roller of the pair of delivery rollers is constructed as an over-mounted shaft which, at its end, is provided with the covering.

9. A drafting unit according to claim 8, wherein the pressure rollers of the pairs of delivery rollers of common paired drafting units are constructed as a pressure roller twin and have a common bearing tube in which the shafts of the two pressure rollers are disposed.

10. A drafting unit according to claim 1, wherein the pressure rollers of the pairs of delivery rollers of two adjacent drafting units are constructed as pressure roller twins and have a common bearing tube in which a common shaft is disposed which, at its ends, is provided with the coverings.

11. A drafting unit according to claim 1, wherein the pressure roller of the pair of delivery rollers has a tube-shaped basic body which is disposed on a shaft in the area of the covering, by means of a needle bearing.

12. A drafting unit according to claim 11, wherein the tube-shaped basic body is provided with a widening laterally next to the covering, and in this area, in addition, is disposed on the shaft by means of a ball bearing.

13. A drafting unit according to claim 1, wherein the covering of the pressure roller of the pair of delivery rollers is applied to a thin metallic bushing.

* * * * *